US005081966A

United States Patent [19]

Hansen et al.

[11] Patent Number: 5,081,966

[45] Date of Patent: Jan. 21, 1992

[54] INTERNAL COMBUSTION ENGINE WITH ROTARY VALVE ASSEMBLY

[75] Inventors: Craig N. Hansen, Minnetonka; Paul C. Cross, Minneapolis, both of Minn.

[73] Assignee: Hansen Engine Corporation, Minnetonka, Minn.

[21] Appl. No.: 666,851

[22] Filed: Mar. 8, 1991

Related U.S. Application Data

[63] Continuation-in-part of Ser. No. 248,946, Sep. 23, 1988, Pat. No. 5,000,136, and a continuation-in-part of Ser. No. 899,157, Aug. 22, 1986, Pat. No. 4,773,364, said Ser. No. 899,157, is a continuation-in-part of Ser. No. 671,573, Nov. 15, 1984, Pat. No. 4,612,886.

[51] Int. Cl.[5] ..... F01L 7/10

[52] U.S. Cl. ..... 123/190 B; 123/190 BB; 123/80 BB

[58] Field of Search ..... 123/190 R, 190 B, 190 D, 123/190 E, 190 BB, 80 BB

[56] References Cited

U.S. PATENT DOCUMENTS 1,651,207 11/1927 Hodges ..... 123/190 LD
3,130,953 4/1964 Carpenter ..... 123/190 D
4,494,500 1/1985 Hansen ..... 123/190 E

*Primary Examiner*—Raymond A. Nelli
*Assistant Examiner*—Erick Solis
*Attorney, Agent, or Firm*—Burd, Bartz & Gutenkauf

[57] ABSTRACT

An internal combustion engine having a head with valve assemblies for controlling flow of intake and exhaust gases to and from piston chambers. A head plate is located between the head and a block having cylinders accommodating pistons. The head plate has openings in communication with the cylinders and valve assemblies. Each valve assembly has a continuous ceramic sleeve having an intake port, and an exhaust port. Rotatably disposed within the sleeve is a rotatable valve body having a valving combustion chamber open to a piston chamber. A spark plug is mounted on each valve body. A first pressure responsive seal mounted on the valving body has a sealing surface engageable with the sleeve. A second pressure responsive face seal is located between the head plate and the rotating valve body. The valving body and first seal are rotatably driven to sequentially align the valving combustion chamber with the intake port and exhaust port during the operation of the engine.

34 Claims, 9 Drawing Sheets

INTERNAL COMBUSTION ENGINE WITH ROTARY VALVE ASSEMBLY

CROSS REFERENCE TO RELATED APPLICATIONS

This application is a continuation-in-part of U.S. application Ser. No. 248,946 filed Sept. 23, 1988 now U.S. Pat. No. 5,000,136.

Application is a continuation-in-part of U.S. application Ser. No. 899,157 filed Aug. 22, 1986, now U.S. Pat. No. 4,773,364.

Application Ser. No. 899,157 is a continuation-in-part of U.S. application Ser. No. 671,573 filed Nov. 15, 1984, now U.S. Pat. No. 4,612,886.

FIELD OF INVENTION

The invention pertains to an internal combustion engine having a rotary valve assembly with a valving combustion chamber accommodating burning fuel and to control the flow of intake and exhaust gas into and from an expansion chamber in communication with the valving combustion chamber.

BACKGROUND OF INVENTION

Rotary valves have been proposed for use with internal combustion engines. These valves have valving members drivably connected to the crankshafts of the engine to sequentially allow intake gas, such as an air and fuel mixture, to flow into the engine and exhaust gas to flow out of the engine. An example of a rotary valve mechanism for an internal combustion engine is described by Carpenter in U.S. Pat. No. 3,130,953. This valve mechanism has a rotary valve body rotatably located in a head. The head is mounted on top of a cylinder. A self-sealing split sleeve device associated with the body functions as a valving member and seal. The sleeve is a metal cylindrical member having a hole and a longitudinal split. In use the sleeve deforms outwardly into circumferential surface sealing engagement with an inside cylindrical wall of the head to close the intake and exhaust ports. Hodges in U.S. Pat. No. 1,651,207 discloses an internal combustion engine having a rotary valve located over the piston. The valve has a port open to the piston chamber that is sequentially moved into alignment with intake, ignition and exhaust ports. The outer surface of the valve is in surface engagement with the head.

Ceramic materials have been developed for parts of turbine engines and internal combustion engines. Engine designs must accommodate the mechanical, heat, and lubricating characteristics of the ceramic materials. The rotary valve assembly of the present invention has ceramic parts that are compatible with the material of the head, cylinder, and piston of the engine.

SUMMARY OF INVENTION

The invention is directed to an internal combustion engine having rotary valve assemblies and a head plate located between the piston and valve assemblies. The valve assemblies are usable as a substitute for the conventional poppet valves and cam shaft arrangements used in conventional internal combustion engines. The valve assemblies have a simplified construction which can be readily serviced and maintained without major repair of the engines. In operation, the valve assemblies are usable with high speed engines. The conventional problem with valve float associated with poppet valves is not present in the rotary valve assembly.

The internal combustion engine has a block with a plurality of bores accommodating reciprocating pistons. The bores and pistons provide the compression and expansion chambers for accommodating a burning air/fuel mixture and exhaust gases. The rotary valve assemblies located in a head are concurrently driven with a valve drive operatively connected to the crankshaft of the engine. A head plate has openings providing communication between the rotary valve assemblies and the compression and expansion chambers. The head plate reduces the pressure induced thrust forces on the rotary valve assemblies and minimizes the quenched volume of air and fuel mixture adjacent to the valving combustion chambers. Substantially all of the air/fuel mixture in the valving combustion chamber is exposed to the flame front with a result in reduction of HC emissions and improved fuel economy. A spark generating means is mounted on the valve and extended into the valve combustion chamber to ignite the air/fuel mixture in the valving combustion chamber. A fuel injector can be mounted on the head plate when the engine is operated as a Diesel engine. An igniter for generating a spark can be used to assist starting of a Diesel engine.

The head has a plurality of bores open to the piston compression and expansion chambers in the block. The bores can be larger than the openings in the head plate. Intake and exhaust gas passages located in the head are open to separate portions of each bore. Each bore accommodates a continuous sleeve having an intake port, and an exhaust port which are aligned with the intake and exhaust gas passages in the head. The intake and exhaust ports have generally rectangular shapes to improve the rate of opening and closing the gas flow area of the ports. The sleeve is a cylindrical member having a cylindrical inner surface. The sleeve can be made of ceramic material or metal.

A rotatable valve assembly having a combustion chamber open to both the piston chamber and the inner surface of the sleeve is rotatably located within each sleeve. Each valve assembly includes a rotary valve body located within the sleeve. The bottom of the valve body is located adjacent the head plate with intermediary seal elements to reduce the thrust forces on the valve body minimize crevice volumes. A pressure activated seal is interposed between the head plate and bottom of the valve body. The opening in the head plate connects the valving combustion chamber with the piston chamber. The valve body has an outside cylindrical wall positioned in spaced contiguous relationship to the inside wall of the sleeve. The valve body rotatably mounted on the head with low friction bearings has a rotatable valving combustion chamber for accommodating air/fuel mixture and exhaust gases. An igniter, such as a spark plug, is mounted on the valve body with spark electrodes within the valving combustion chamber. A seal mounted on the valve body is located in sealing relation with the inside surface of the sleeve. The seal maybe a ceramic member or wear resistant metal drivably mounted on the valve body.

In one embodiment the seal is a segment seal that has a range of radial and pivotal movement so that it can freely maintain sealing engagement with the inner surface of the sleeve. The segment seal has upper and lower pivot pins that extend into notches in the valve body. The pins allow the segment seal to pivot about an axis that is parallel to the inner surface of the sleeve. The segment seal includes a pressure activated ring seal which bears against the valve body to provide a gas-tight seal at a minimum of friction of the segment seal with the sleeve and allows for the less stringent machining tolerances of the valve body.

In another embodiment of the valve assembly, the seal is a collar seal that surrounds the valve body. The sleeve and collar seal have cooperating sealing surfaces that effectively maintain an effective seal with minimum wear on the cooperating sealing surfaces. Pressure activated structures responsive to the high compression and fuel burning pressures in the combustion chamber of the valve body act on the collar seal adjacent the inlet to the combustion chamber to increase the sealing efficiency of the collar seal. A second pressure activated face seal located between the head plate and bottom of the valve body around the outlet of the combustion chamber is also responsive to the high pressure in combustion chamber to effectively seal the valve body relative to the head plate.

The rotary valve assembly provides for an air/fuel stratification in the valving combustion chamber when fuel is mixed with the air during the compression stroke intake This enhances the ignition of the air/fuel mixture and allows for an overall relatively lean air/fuel mixture. The rotary valve body causes circulation and turbulence of the air/fuel mixture in the piston chamber. Pre-ignition and end-gas detonations are reduced.

The rotary valve assemblies can be directly removed from the head. The head and its attendant intake and exhaust manifolds and cooling system need not be removed from the engine in order to provide access to the valve assemblies. Neither initial installation nor accumulated wear affects require adjustment of the valve parts. All fits and clearances are established by manufactured dimensions such that the initial assembly consists of simple synchronization indexing of the valve drive shaft and valve bodies.

DESCRIPTION OF PREFERRED EMBODIMENTS

Figure 1:
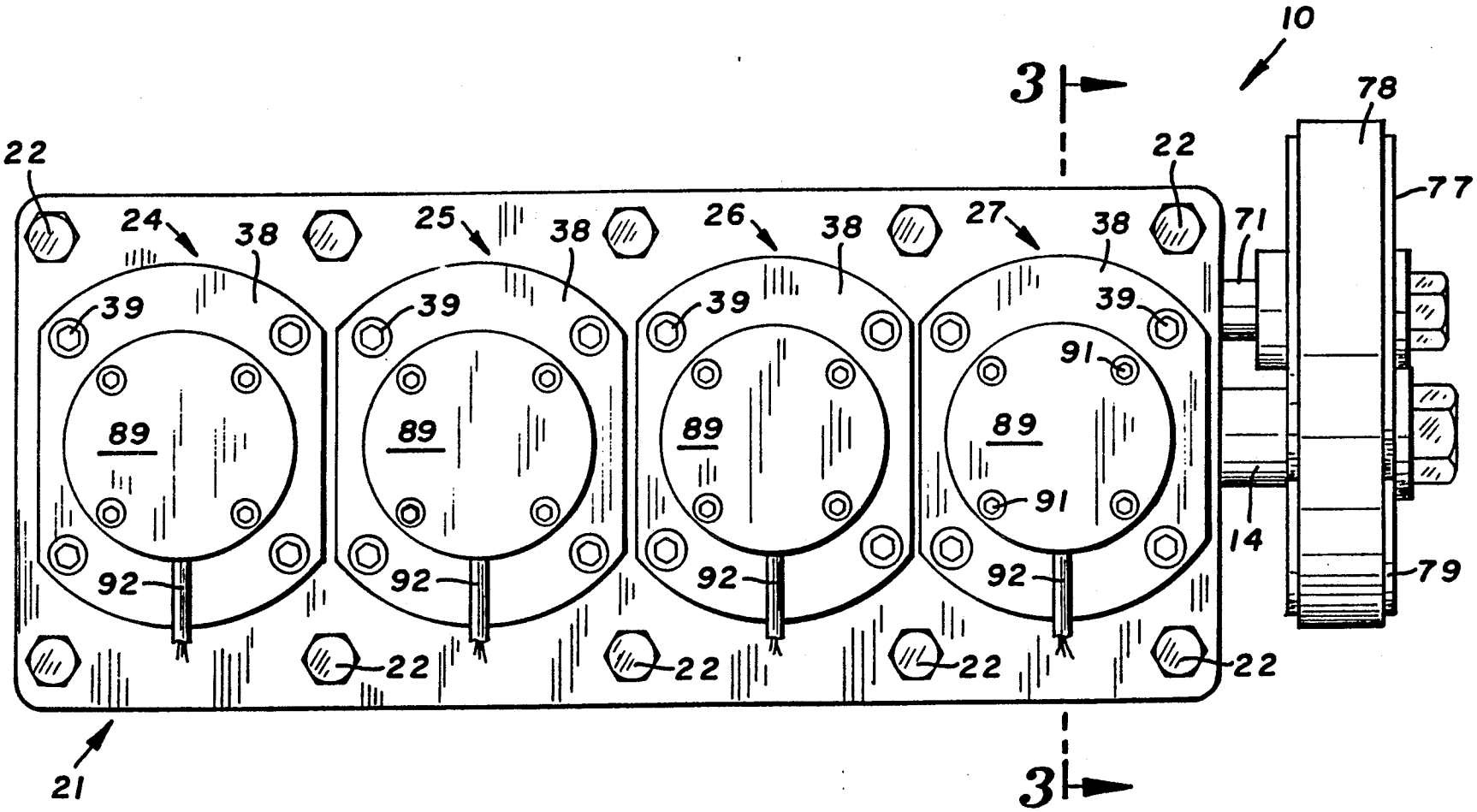
FIG. 1 is a top view of an internal combustion engine equipped with rotary valve assemblies of the invention.
Figure 2:
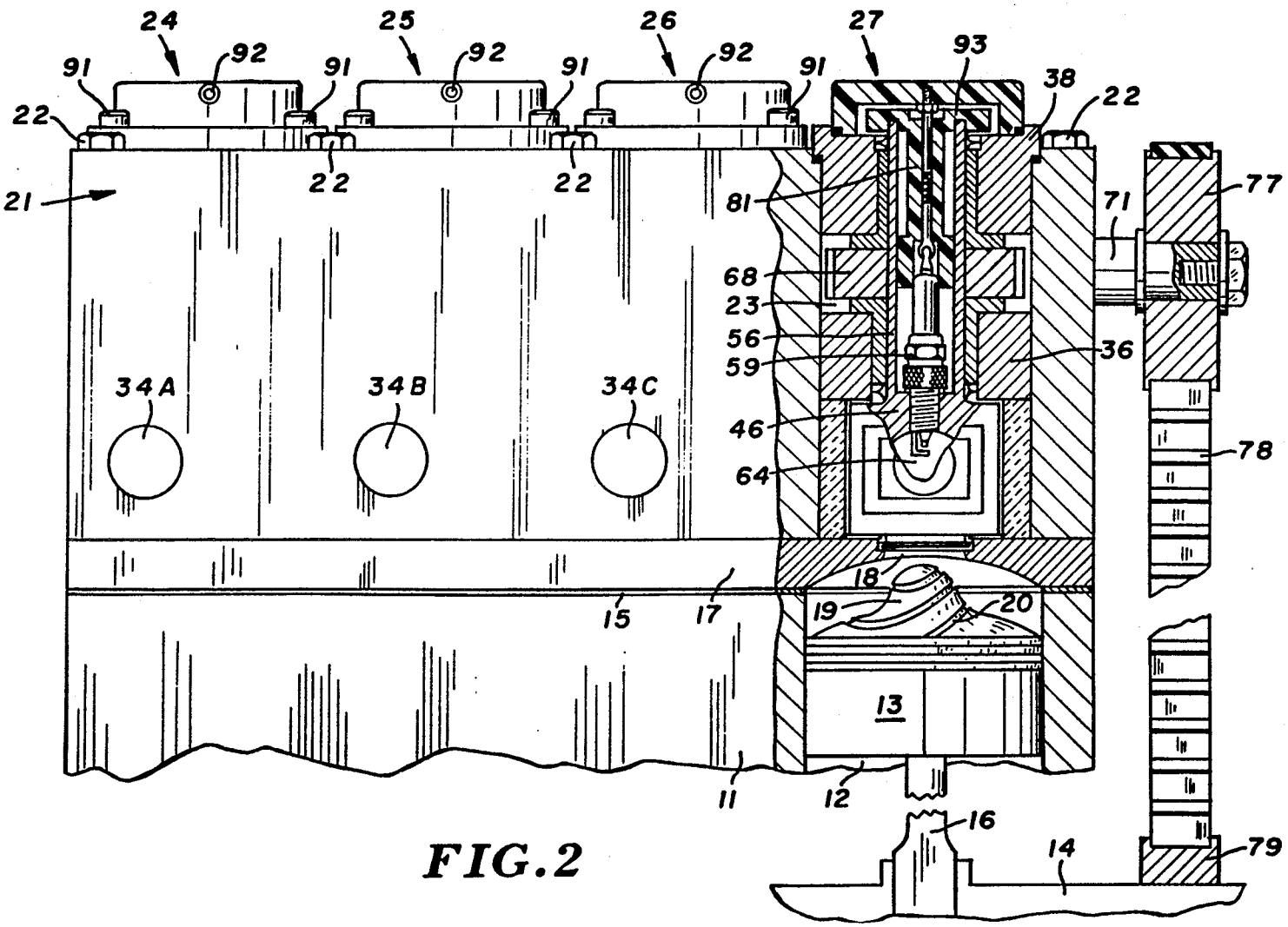
FIG. 2 is a side view, partly sectioned, of the engine of FIG. 1.

Referring to FIGS. 1 and 2, there is shown a four cycle internal combustion engine indicated generally at 10 equipped with rotary valve assemblies 24, 25, 26 and 27 having rotary valving combustion chambers. The air/fuel mixture introduced into the rotary valving combustion chambers stratifies to allow effective ignition in lean burn environments. The air/fuel mixture in the rotary combustion chambers has circulation and turbulence providing an effective and efficient propagation of the flame front in the valving combustion chambers and expansion chambers. Engine 10 has a block 11 containing four upright cylinders or bores 12. The number of bores in block 11 can vary according to the design of the engine Each bore 12 accommodates a reciprocating piston 13 having conventional piston rings. Piston 13 is slidably located in bore 12 providing an expansion chamber when piston 13 moves in its intake and power strokes Each piston 13 is connected to a conventional crankshaft ]4 with a connecting rod 16. As shown in FIG. 2, a flat metal head plate 17 is located on top of block 11. A gasket 15 is located between the bottom of plate 17 and the top of block 11. Block 11, head plate 17, and head 21 can be a one piece structure, such as cast metal. Bores 12 and 23 in the one piece structure can be machined on opposite sides of the head plate portion of the structure. This eliminates gasket 15 as the head plate is integral with block 11. Head plate 17 has a circular opening 18 aligned with the central vertical axis of bore 12. An opening in head plate 17 is aligned with but not necessarily concentric with each bore in block 11. Head plate 17 and associated seal 52 reduce the thrust forces on the valve assemblies and reduce the quenched volume of the air/fuel mixture adjacent to the valving combustion chambers. Substantially all of the air and air/fuel mixture in the valving combustion chambers are exposed to flame fronts with a result in reduction of HC emissions and improved fuel economy. Piston 13 has an upwardly directed central projection 19 that is located in opening 18 when piston 13 is at top dead center or at the completion of the compression stroke and exhaust stroke. Projection 19 increases the compression of the air/fuel mixture in the rotary valving combustion chamber, and facilitates a generally cylindrical expanding flame front over the top of piston 13 during the power stroke. Projection 19 may have a plurality of helical grooves 20 to induce swirl or turning motion to the air/fuel mixture and burning fuel in the combustion and expansion chambers. Pistons without projections 19 can be used in the internal combustion engine.

A head indicated generally at 21 is located on top of head plate 17. A plurality of head bolts 22 secure head 21 and head plate 17 to block 11. Head 21 has a plurality of vertical bores 23 accommodating rotary valve assemblies indicated generally at 24, 25, 26 and 27 for directing the flow of air/fuel mixture into the rotary valving combustion chambers, exposing the air/fuel mixture to an ignition spark, directing the burning and expanding gases into the expansion chambers and controlling the flow of exhaust gases out of the valving combustion chambers and expansion chambers. Rotary valve assemblies 24, 25, 26 and 27 are identical in structure and function. The following description is directed to rotary valve assembly 27.

Figure 3:
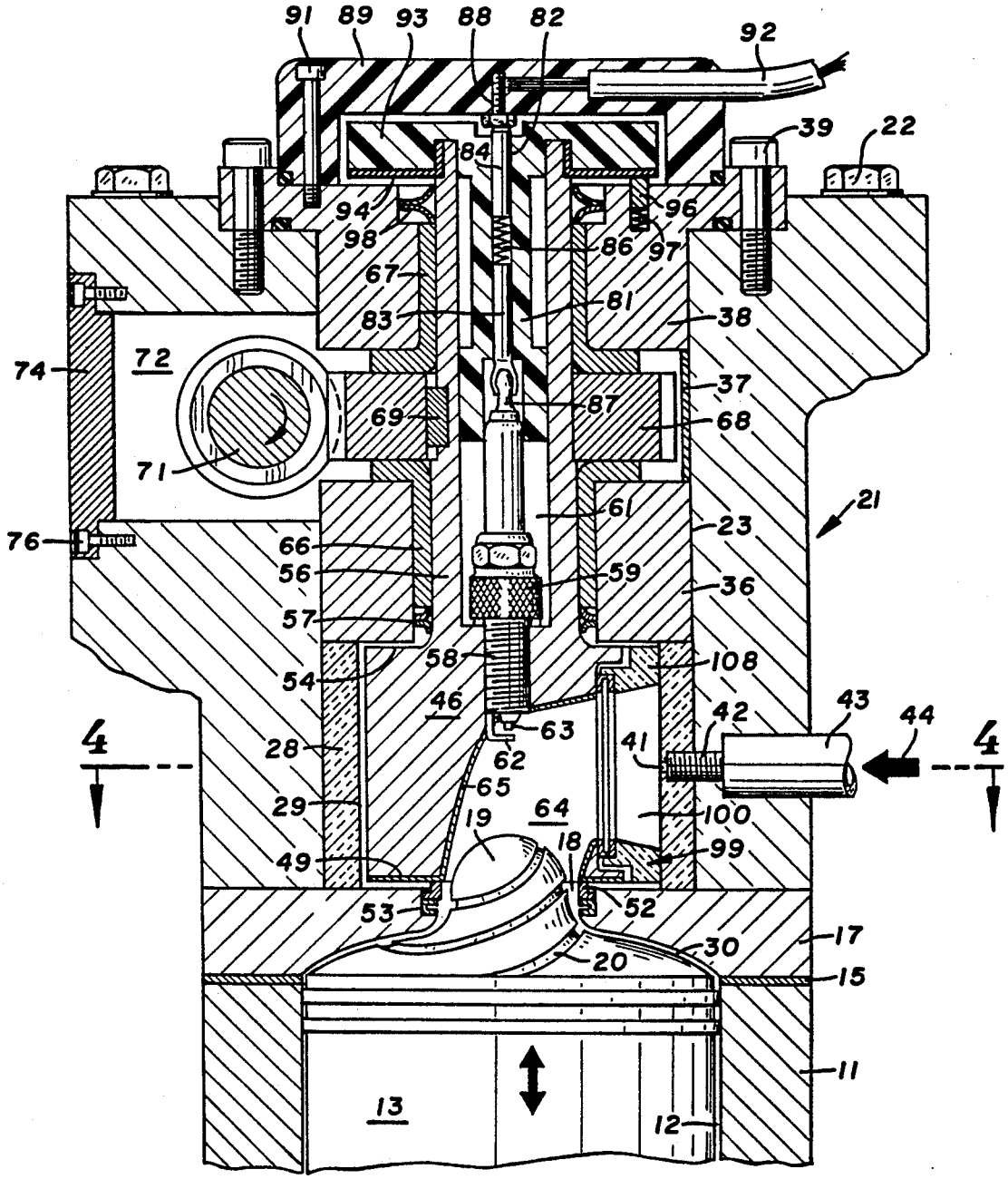
FIG. 3 is an enlarged sectional view taken along the line 3—3 of FIG. 1.
Figure 4:
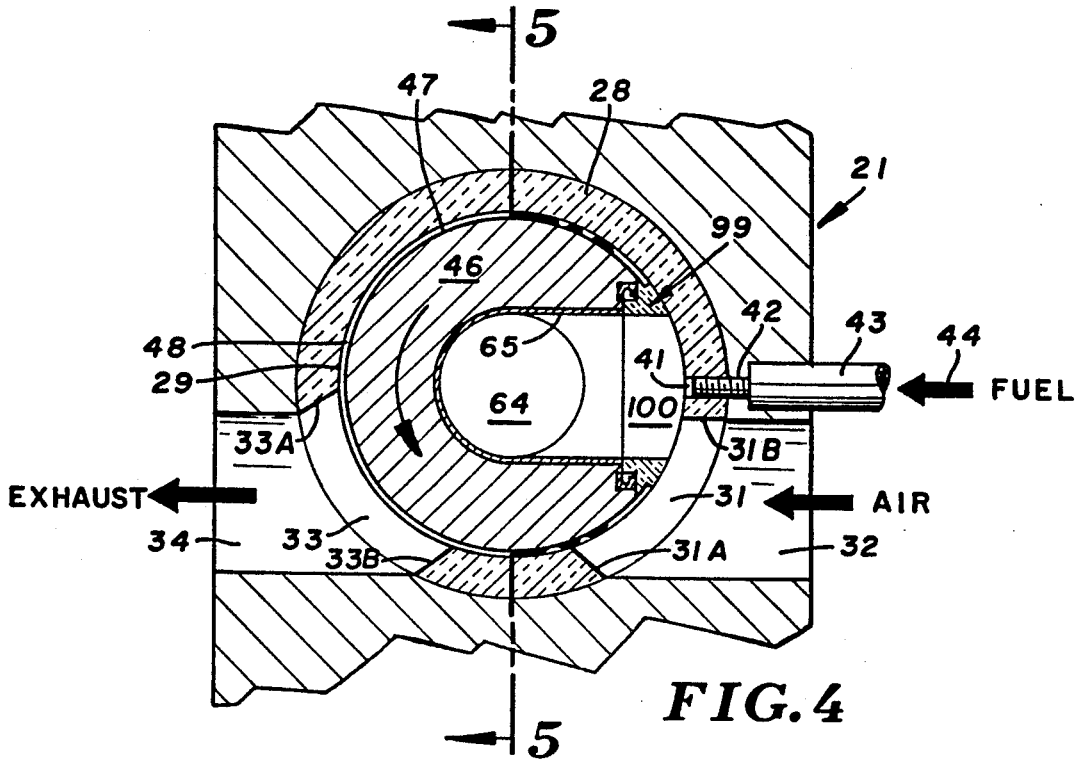
FIG. 4 is a sectional view taken al :g the line 4—4 of FIG. 3.

Referring to FIGS. 3 and 4, rotary valve assembly 27 has a cylindrical sleeve 28 positioned in the bottom of bore 23. The lower end of sleeve 28 bears against the top of head plate 17. Sleeve 28 is a circular cylindrical member having an inside cylindrical surface 29, an intake port 31, and exhaust port 33. Intake port 31 is aligned with intake passage 32 located in head 21. Exhaust port 33 is aligned with exhaust passage 34 in head 21 opposite passage 32. Sleeve 28 can be removed from bore 23 to facilitate servicing and repair of the engine. The location of the circumferentially spaced edges 31A, 31B and 33A, 33B of sleeve 28 forming intake port 31 and exhaust port 33 can be changed to adjust the timing of the valve events. Replacement of sleeve 28 with an alternative sleeve which has appropriate port edge locations, such as vertical edges surround square or rectangular ports allow the engine to be designed for different efficient operating speeds. Sleeve 28 can be a ceramic material, such as silicon nitride, silicon carbide, or a ceramic including silicon, aluminum, oxygen, nitrogen, and other matrials. A sleeve 28 of ceramic material functions as a heat insulator to restrict the dissipation of heat to head 21. Sleeve 28 can also be made of other materials, such as metal, carbon or the like.

Returning to FIG. 2, head 21 has additional exhaust passages 34A, 34B, and 34C for rotary valve assemblies 25, 26 and 27. Additional intake passages are located in the opposite side of head 21. Intake and exhaust manifolds (not shown) are used to supply an air/fuel mixture or air for a Diesel engine to the intake passages 32 and carry exhaust gases from exhaust passages 34, 34A, 34B and 34C to an emission control and sound suppression device open to atmosphere. Returning to FIG. 3, sleeve 28 is held in a fixed position against head plate 17 by ring 36 and spacer sleeve 37 located in bore 23. A cap 38 engagable with sleeve 37 holds ring 36 and sleeve 37 and sleeve 28 in bore 23. Cap 38, sleeve 37, ring 36, and sleeve 28 can be a single piece of metal or intergrated structure. A plurality of bolts 39 secure cap 38 to the top of head 21. Cap 38 is removable from head 21 to allow the entire valve assembly 27 to be withdrawn from block 11 or removal of the intake and exhaust manifolds.

Sleeve 28 has a fuel inlet port 41 located adjacent the air inlet port 31. Port 4]is aligned with a threaded bore 42 in head 21. A fuel injector 43 is located in bore 42 and threaded into port 41 so that fuel can be injected directly into the combustion chamber. The fuel injector can be mounted on head 21 so that the fuel is injected into the inlet port 31 immediately. Alternatively, the fuel injector can be mounted on head 21 so that the fuel is injected about midway or any intermediate location between the inlet port 32 and the outlet port 33. The fuel is supplied under pressure to fuel injector 43 as indicated by arrow 44 in FIG. 4. The details of the fuel injector are not specifically described as they do not form part of this disclosure. An example of a fuel injector is shown in U.S. Pat. No. 4,033,507.

A cylindrical valve body 46 is located within sleeve 48. Body 46 has an outside cylindrical wall 47 positioned in spaced continguous relation relative to inside wall 46 of sleeve 48. An annular cylindrical space 48 separate the outside cylindrical wall 47 from the inside wall 29 of sleeve 28. Sleeve 28 surrounds the entire outside of body 46. Wall 47 of body 46 does not have a precise machine finish as it does not engage wall 29 of sleeve 28. In other words, there is no frictional relationship between walls 47 and 29. The bottom of body 46 has a flat bottom surface 49 facing the head plate 17. Surface 49 can have a ceramic coating to enhance its wear characteristics. The entire body 46 can be made from a ceramic. The walls surrounding chamber 64 may have a coating or layer 65 of ceramic material to reduce heat loss to the metal of body 46.

Figure 5:
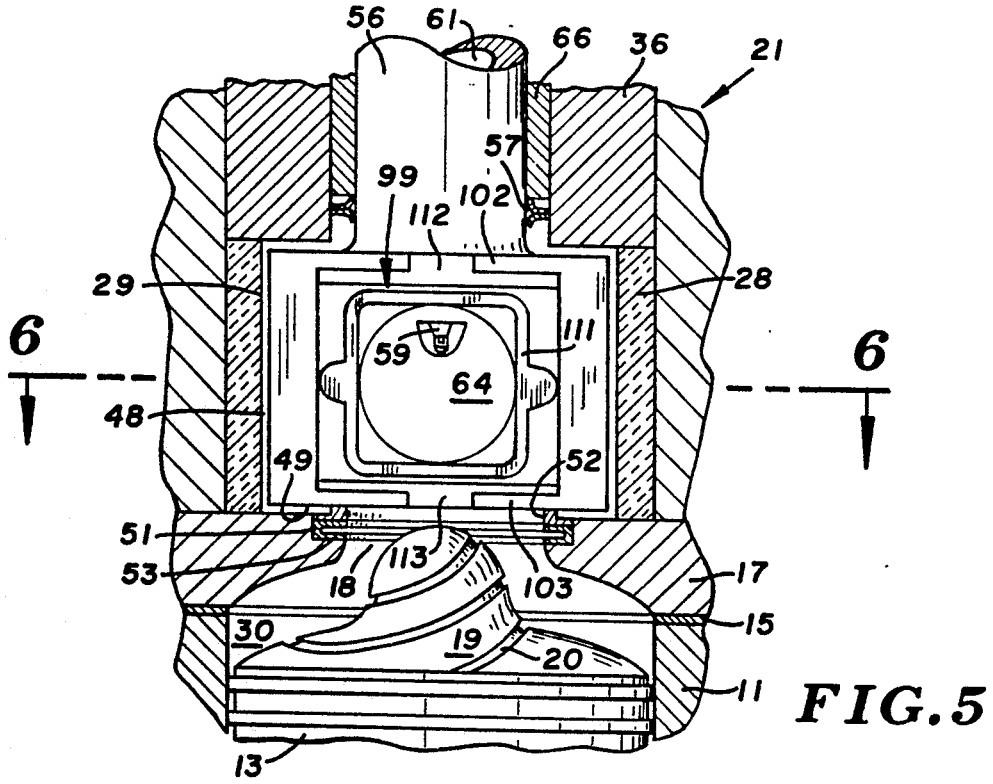
FIG. 5 is a sectional view taken along the line 5—5 of FIG. 4 showing the full front face of the rotary valve.

As shown in FIGS. 3 and 5, head plate 17 has an annular groove 51 surrounding opening 18. A ring seal 52 located in groove 51 is biased with a circular spring 53 into engagement with the bottom surface 49 of the valve body 46. The outer edge of seal 52 has radial projections to prevent turning of the seal with valve body 46. Seal 52 is a pressure active face seal that has a high unit load on bottom surface 49 during the compression and power strokes of piston 13. The high unit load is effected by transfer of high pressure gasses into the annular space surrounded by circular spring 53. Seal 52 is preferrably made of ceramic material to enhance its wear and temperature characteristics. Alternatively, a split ring located in an annular groove in head plate 17 and engagable with seal 52, along with a spring in the groove, can be used to hold seal 52 in sliding sealing engagement with the bottom surface 49 of valve body 46.

Valve body 46 has a generally flat top wall 54 facing the bottom of member 36. An upright tubular shaft or stem 56 intergral with the center portion of top wall 54 extends upwardly through the ring 36 and cap 38. Bearings 66 and 67 surrounding shaft 56 rotatably mount the shaft on ring 36 and cap 38. A lip seal 57 interposed below bearing 66 is positioned in sealing engagement with the outside surface of shaft 56. The center of body 46 has an upright threaded bore 58 that accommodates the threaded end of a spark plug 59. The spark plug 59 is located within the upright passage 61 of shaft 56 in the longitudinal or rotational axis of valve body 46. The lower end of spark plug 59 has spaced electrodes 62 and 63 located in center portion of the top of combustion chamber 64 within valve body 46. Spark plug 59 is one form of a fuel igniter. Glow plugs and other devices ca be used to ignite the fuel in the combustion chamber. Shaft 56 is rotated with a gear 68 located between ring 36 and cap 38. A key 69 secures and indexes gear 68 to shaft 56. A worm gear or spiral-drive 71 longitudinally extended along the length of head 21 in a side horizontal chamber 73 functions to simultaneously rotate all of gears 68 thereby concurrently rotate all of the valve bodies of the engine at a one-half of engine crank shaft speed. A cover plate 74 conceals worm gear 71 within chamber 72. A plurality of bolts 76 secure cover plate 74 to head 21. As seen in FIG. 2, worm gear 71 is rotated with a belt and pulley power transmission from crank shaft 14. A driven pulley 77 is mounted on the outer end of worm gear 71. A timing belt 78 operatively connects pulley 77 to a driven pulley 78 mounted on the crank shaft 14. Other types of power transmitting structures, such as gears or roller chains can be used to rotate valve bodies 46 in a 2 to 1 timing relation with the rotation of the crank shaft.

A sleeve 82 for ignition rotor 81 extends down into passage 61 of shaft 56. As shown in FIG. 3, sleeve 82 has a vertical hole 82 that accommodates a pair of conductor rods 83 and 84 biased from each other with a coil spring 86. Sleeve 81 is nonconducting material, such as plastic The lower end of sleeve 81 fits over the top of spark plug 59 so that conductor 83 engages the top conductor 87 of the spark plug. Conductor or brush 84 contacts the head of a bolt 88 secured to an ignition cover 89. Cover 89 is an inverted cup-shaped rigid plastic member. A plurality of bolts 91 secure ignition cover 89 to the top of cap 38. As shown in FIG. 1 ignition wires or cables 92 connect ignition cover 89 to the ignition system (not shown) of the engine. Ignition system can be a conventional distributor coil circuit connected to bolt 88. Cable 92 contain wires that are electrically connected to bolt 88. A lip seal 98 is located between the top of cap 38 and the top of shaft 56 below head 93 to prevent contamination of bearing 67.

Returning to FIG. 3, sleeve 81 has a generally circular head 93 located below ignition cover 89. An electric conductor or slip ring 94 is secured to the bottom of head 93. Conductor 94 is engaged by a brush 96 of electrical conductive aterial. Brush 96 located in a bore in the top of cap 38 is biased upward into engagement with slip ring 94 with spring 97. Slip ring 94 and brush 96 completes the electrical circuit between valve body 46 and head 21. Other structures and conductor arrangements can be used to complete the circuit for the ignition system.

Figure 6:
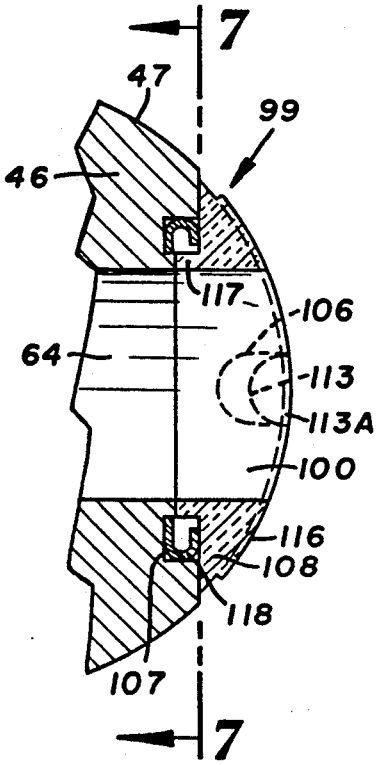
FIG. 6 is an enlarged sectional view taken along the line 6—6 of FIG. 5.
Figure 7:
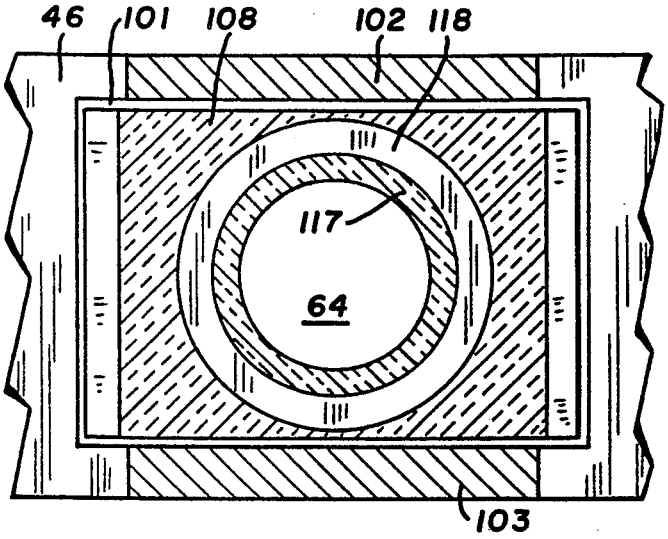
FIG. 7 is an enlarged sectional view taken along line 7—7 of FIG. 6.
Figure 8:
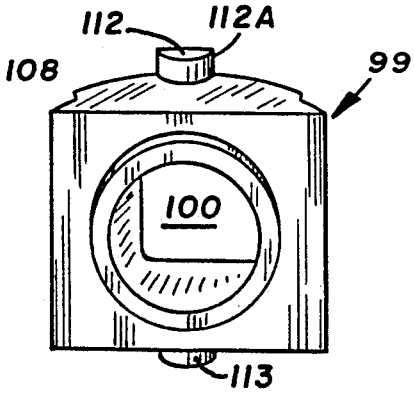
FIG. 8 is perspective view of segment seal of the rotary valve as seen from the back side thereof.
Figure 9:
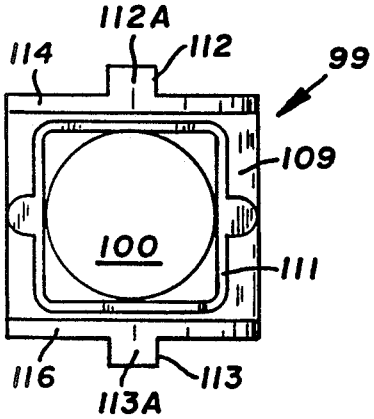
FIG. 9 is a front view of the outside face of the segment seal of the rotary valve.
Figure 10:
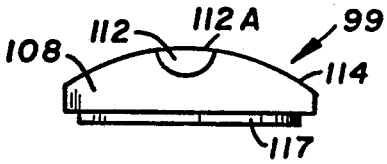
FIG. 10 is a top view of the segment seal of the rotary valve.
Figure 11:
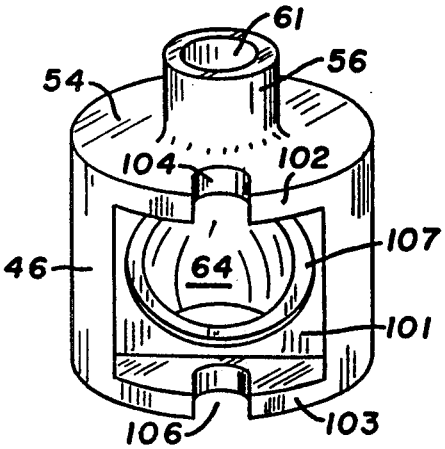
FIG. 11 is a perspective view of the valve body of the rotary valve.

As shown in FIGS. 4, 5, and 6, a segment seal 99 having a passage 100 is mounted of valve body 46 in alignment with the inlet of combustion chamber 64. Segment seal 99 engages the inner surface 29 of sleeve 28 to provide an effective low friction seal. The valve body 46 has a front pocket 101 that accommodates segment seal 99. Outwardly directed arcuate lips 102 and 103 are located above and below pocket 101. Lip 102 has a recess 104 aligned with a recess 106 in lip 103. The back wall of the pocket 101 has a counter bore 107 surrounding the passage of 100.

Segment seal 99 has a body 108 of ceramic, metal or like material. Body 108 has an outer convex face 109 that has a generally rectangular contact surface 111 surrounding the inlet of the passage 100. Oppositely directed tongues or posts 112 and 113 are secured to the top and bottom portions of body 108. A top land 114 is concentric with the outer surface **112*a* of post 112. A bottom circumferential land 116 is concentric with the outer surface 113*a* of post 113. The lands 116, 111, and 114 and post surfaces 112*a* and 113*a* have the same radius of curvature. This radius of curvature is slightly larger than the radius of curvature of the inner surface 29 of sleeve 28. The back side of body 108 has a cylindrical boss 117 that fits into counter bore 107. A seal 118 is located in counter bore 107 as seen in FIG. 6, to bias segment seal 99 into sealing engagement with the inner surface 29 of sleeve 28 and seal the small space between the inner side of body 108 and the valve body 46**.

Returning to FIGS. 1 and 2, the valve body drive is operable to rotate worm gear 71 thereby simultaneously turn the valve bodies in a two to one time relation with the rotation of crank shaft 14. Worm gear 71 is rotatably mounted on head 21 with suitable bearings (not shown) and has helical threads or worm threads in driving engagement with gear 68 and the gears for the other valve bodies to concurrently turn valve bodies 46. The valve bodies of the engine are identical in structure to the valve body shown in FIGS. 3 to 11 including segment seal 99 carried by valve body 46. Each valve body 46 has a combustion chamber or passage 64 for carrying air/fuel mixture to the piston compression and expansion chamber 18 and exhaust gases therefrom. Chamber 64 is open to passage 100 and expansion chamber 30 via opening 18 in head plate 17. Segment seal 99 has outer contact surfaces or the lands 114 and 116 and a generally rectangular rim seal surface 111 that are in sliding sealing contact with inside surface 29 of sleeve 28. The remaining outer surface of body 108 is relieved. In other words, only land 114 and 116 and surface 111 are in surface contact with inner surface 29 of sleeve 28 The entire outer surface 47 of valve body 46 is separated by space 48 from inner surface 29 thereby minimizing the resistance to rotation of valve body 46 within sleeve 28. Seal 118 is a pressure activated annular seal. The grooves 20 and projection 19 on piston head 13 also provides for swirling and turbulant movement of the air/fuel mixture in the valving combustion chamber 64. This reduces detonation and enhances the efficient combustion of the air/fuel mixture in chamber 64. Seal 52 prevents the air/fuel mixture from entering annular space 48 surrounding the valve body 46. Seal 52 is a pressure activated seal which remains in contact at all times with respect to valve body 46.

The geometry of combustion chamber 64 allows for the intake and exhaust gasses to flow to and from the working or piston chamber 30 with minimal restrictions. Opening 18 in head plate 17 is not restricted so that the burning fuel and expanding gases freely flow into and out of piston chamber 30.

Valve body 46 along with spark plug 59 can be removed as a unit from the head 21. The screws 39 attaching cap 38 to head 21 are removed. Valve body 46 along with spark plug 59, ring 36 and cap 38 are removed as a unit from head 21. The intake in exhaust manifolds and ignition system for the engine as well as parts of the cooling system are not disturbed during the removal and servicing of the valve assembly.

Figure 12:
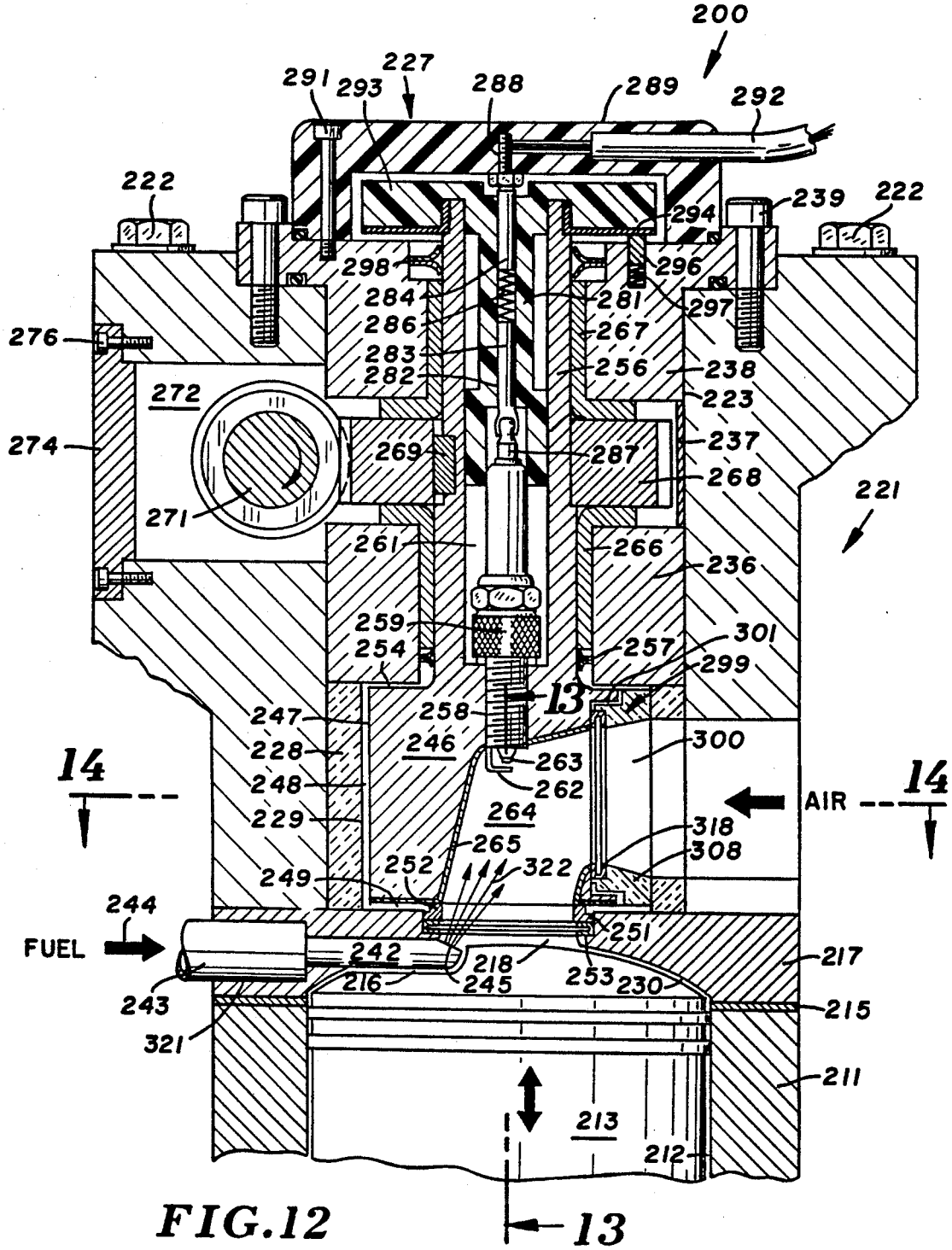
FIG. 12 is a sectional view similar to FIG. 3 of a modification of the engine and rotary valve thereof.
Figure 13:
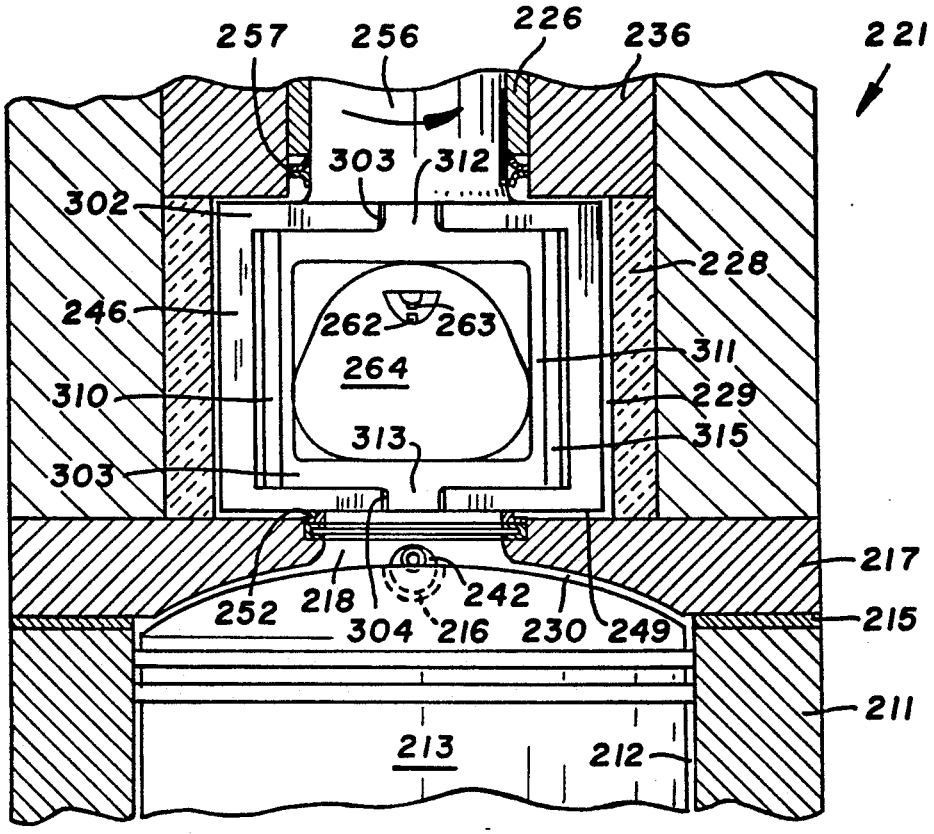
FIG. 13 is an enlarged sectional view taken along line 13—13 of FIG. 12.
Figure 14:
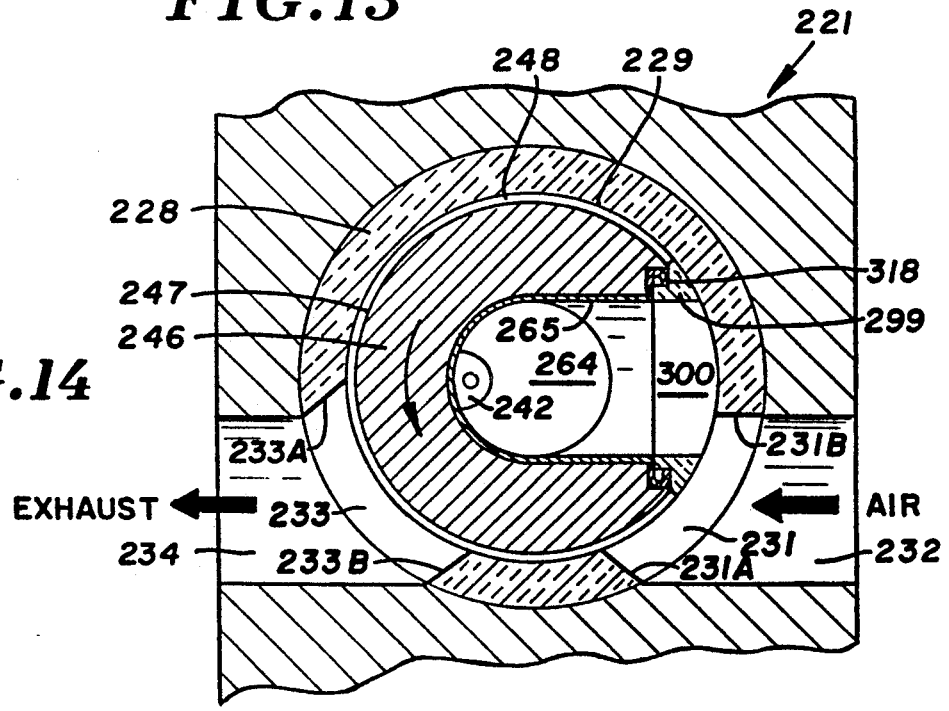
FIG. 14 is a sectional view taken along line 14—14 of FIG. 12.

Referring to FIGS. 12 to 14 there is shown a modification of the engine 200 and valve assembly indicated generally at 227 of the internal combustion engine 200. Valve assembly 227 and parts of the engine 200 that are the same as the parts of engine 10 have the same reference number with the prefix 2.

Engine 200 has a block 211 having four upright cylinders or bores 212. The number of bores in block 211 can vary according to the design of the engine. Each of the bores accommodates a piston 213. Piston 213 is slidably located in bores 212 and connected to a conventional crankshaft with a connecting rod (not shown).

As shown in FIG. 12, a head plate 217 located on top of block 211 covers the piston expansion chamber. A gasket 215 located between the bottom of plate 217 and the top of block 211 seals head plate 217 on block 211. Head plate 217 has a circular opening 218 aligned with the central vertical axis of bore 212. Opening 218 is open to a recess 230 in the bottom of plate 217. As shown in FIG. 12, head plate 217 has a side hole 321 accommodating part of a fuel injector 243. Injector 243 has a nozzle 242 terminating in a discharge end 245 operable to direct atomized fuel shown by arrows 322, such as gasoline or diesel fuel, into valving combustion chamber 264. An example of a fuel injector is disclosed by G. Fromel and P. Langenberger in U.S. Pat. No. 4,033,507. The top of piston 213 has a radial groove 216 for nozzle 242 to reduce the head dead center volume of the piston expansion chamber and volume of the combustion chamber. Head plate 217 in association with seal 252 act to reduce the thrust forces on the valve assemblies and reduce the quenched volume of the air/fuel mixture adjacent to the valving combustion chambers. Substantially all of the air/fuel mixture in the valving combustion chambers is exposed to flame fronts with a result in reduction of HC emssions and improved fuel economy.

A head indicated generally at 221 is located on top of head plate 217. A plurality of head bolts 222 secure head 221 and head plate 217 to block 211. Head 221 has a plurality of vertical bores 223 accommodating rotary valve assemblies indicated generally at 227 for directing the flow of air/fuel mixture into the rotary valving combustion chambers, exposing the air/fuel mixture to an ignition spark, directing the burning and expanding gases into the expansion chambers, and controlling the flow of exhaust gases out of the valving combustion chambers and piston expansion chambers. Rotary valve assembly 227 is identical in structure and function to the other rotary valve assemblies of the engine. The following description is directed to rotary valve assembly 227.

Referring to FIGS. 12 and 14, rotary valve assembly 227 has a cylindrical sleeve 228 positioned in the bottom of bore 223. The lower end of sleeve 228 bears against the top of head plate 217. Sleeve 282 is a circular cylindrical member having an inside cylindrical surface 229, an intake port 231, and exhaust port 233. Intake port 231 is aligned with intake passage 232 located in head 221. Exhaust port 233 is aligned with exhaust passage 234 in head 221 opposite passage 232. Sleeve 228 can be removed from bore 223 to facilitate servicing and repair of the engine. The location of the circumferentially spaced edges 231A, 231B and 233A, 233B of sleeve 228 forming the intake port 231 and exhaust port 233 can be changed to adjust the timing of the valve events. Replacement of sleeve 228 with an alternative sleeve which has appropriate edge locations, such as vertical edges allow the engine to be designed for different efficient operating speeds. Sleeve 228 can be a ceramic material, such as silicon nitride, silicon carbide, or a ceramic including silicon, aluminum, oxygen, nitrogen, and other materials. A sleeve 228 of ceramic material functions as a heat insulator to restrict the dissipation of heat to head 221. Sleeve 228 can als. be made of other materials, such as metal, carbon or the like.

Returning to FIG. 12, sleeve 228 is held in a fixed position against head plate 217 by ring 236 and spacer sleeve 237 located in bore 223. A cap 238 engagable with sleeve 237 holds ring 236 and sleeve 237 and sleeve 238 in bores 223. Cap 238, sleeve 237, ring 236, and sleeve 228 can be machined from a single piece of metal. A plurality of bolts 239 secure cap 238 to the top of head 221. Cap 238 is removable from head 221 to allow entire valve assembly 227 to be withdrawn from head 221. This is accomplished without removal of head 221 from block 211 or removal of the intake and exhaust manifolds.

A cylindrical valve body 246 is located within sleeve 228. Body 246 has an outside cylindrical wall 247 positioned in space continguous relation relative to inside wall 246 of sleeve 228. An annular cylindrical space 248 separate the outside cylindrical wall 247 from inside wall 229 of sleeve 228. Sleeve 228 surrounds the entire outside of body 246. Wall 247 of body 246 does not have a precise machine finish as it does not engage wall 229 of sleeve 228. In other words, there is no frictional relationship between walls 246 and 229. The bottom of body 246 has a flat bottom surface 249 facing head plate 217. Surface 249 can have a ceramic coating or layer to enhance its wear and heat transfer characteristics. The entire body 246 can be made from ceramic or metal.

As shown in FIG. 12, head plate 217 has an annular groove 251 surrounding opening 218. A ring face seal 252 located in groove 251 is biased with a circular spring 253 into engagement with bottom surface 249 of valve body 246. Seal 252 is a pressure active face seal that has a high unit load on bottom surface 249 during the compression and power strokes of piston 213. The high unit load is effected by transfer of high pressure gases into the annular space surrounded by circular spring 253. Seal 252 is preferrably made of ceramic material to enhance its wear and temperature characteristics. Alternatively, a split ring located in an annular groove and head plate 217 engagable with seal 252 along with a spring in the groove can be used to hold seal 252 in sliding sealing engagement with bottom surface 249 of valve body 246.

Valve body 246 has a generally flat top wall 254 facing the bottom of ring 236. An upright tubular shaft or stem 256 is intergral with the center portion of top wall 254 and extends upwardly through ring 236 and cap 238. Bearings 266 and 267 surrounding shaft 256 rotatably mount shaft 256 on ring 236 and cap 238. A lip seal 257 is interposed below bearing 266 and has sealing engagement with the outside surface of shaft 256. The center of body 246 has an upright threaded bore 258 that accommodates the threaded end of a fuel igniter such as a spark plug 259. Spark plug 259 is located within the upright passage 261 of shaft 256. The lower end of spark plug 259 has spaced electrodes 262 and 263 located in center portion of the top of combustion chamber 264 located within the valve body 246. The walls 265 surrounding chamber 264 are covered or coated with a ceramic material to reduce heat transfer to the metal to valve body 246. Valve body 246 can be used without the coating of ceraminc material.

Shaft 256 is rotated with a gear 268 located between ring 236 and cap 238. A key 269 aligns and secures gear 268 to shaft 256. A worm gear 271 logitudinally extended along the length of head 221 in a side horizontal chamber 272 functions to simultaneously rotate all of the gears thereby concurrently rotate all of the valve bodies of the engine. A cover plate 274 conceals the worm gear 271 within the chamber 272. A plurality of bolt 276 secure cover plate 274 to head 21. Worm gear 271 is driven at a 2 to 1 speed ratio relative to rotated with a belt and pulley power rotation of the crank shaft with suitable drive structure, such as belt and pulleys.

An ignition member 281 extends down into passage 261 of shaft 256. As shown in FIG. 12, member 281 has a vertical hole 282 that accommodates a pair of conductor rods 283 and 284 biased from each other with a coil spring 286. Member 281 is nonconducting material such as plastic. The lower end of member 281 fits over the top of spark plug 259 so that conductor 283 engages the top conductor 287 of the spark plug. Conductor 284 contacts a head of a bolt 288 secured to a plastic ignition cover 289. A plurality of bolts 291 secure ignition cover 289 to the top of cap 238. Ignition wires or cables connect ignition cover 289 to the ignition system (not shown) of the engine. The cable has wires that electrically connected to bolt 288.

Member 281 has a generally circular head 293 located below ignition cover 289. A lip seal 298 is located below head 293 between ring 238 and stem 256 to prevent contamination of bearing 267.

As shown in FIGS. 12 to 14, a segment seal 299 having a passage 300 is mounted on valve body 246 in alignment with the inlet of the combustion chambers 264. The segment seal 299 engages the inner surface 229 of sleeve 228 to provide an effective low friction seal. The valve body 246 has a front pocket 301 that accommodates segment seal 299. Outwardly directed arcuate lips 302 and 303 are located above and below pocket 301. Lip 302 has a recess 303 vertically aligned with a recess 304 in lip 303.

Segment seal 299 has a body 308 of ceramic, metal or like material. Body 308 has an outer convex face that has a generally rectangular contact surface 311 surrounding the inlet of the passage 300. Oppositely directed post 312 and 313 are secured to the top and bottom portions of the body 308. The top and bottom circumferential land surfaces are concentric with the outer surfaces of posts 312 and 313. The land and post surfaces have the same radius of curvature. The radius of curvature of land and post surfaces is complementary to the radius of curvature of the inner surface 229 of sleeve 228. The back side of body 308 has a cylindrical boss 317 that fits into counter bore 307. A seal 318 is located in a counter bore in the back of body 308, as seen in FIG. 14, to bias segment seal 299 into sealing engagement with inner surface 229 of sleeve 228 and seal the small space between the inner side of body 308 and valve body 246.

Returning to FIG. 12, the valve body drive is operable to rotate worm gear 271 thereby simultaneously turn the valve bodies in a 2 to 1 time relation with the rotation of crank shaft. Worm gear 271 is rotatably mounted on head 221 with suitable bearings (not shown) and has helical threads or worm threads in driving engagement with gear 268 to turn the valve bodies 246. The valve bodies of engine 200 ar identical in structure to the valve body shown in FIGS. 3 to 11 including the segment seal 299 carried by the valve body. Each valve body 246 has a valving combustion chamber or passage 264 accommodating an air/fuel mixture which is burned in the chmber. The burning of expanding gases flow to expansion chamber 218. Exhaust gasses flow back thrugh chamber 264 into manifold. Chamber 264 is open to passage 300 and the combustion chamber 230 via the opening 218 in the head plate 217. Segment seal 299 has outer contact surfaces on the lands and rim seal surface 311 that are in sliding sealing contact with the inside surface 229 of sleeve 228. The remaining outer surface of the body 308 is relieved. In other words it is not in surface contact with the inner surface 229 of sleeve 228. The outer surface 247 of valve body 246 is spaced by space 248 from the inner surface 229 thereby minimizing the resistance to rotation of valve body 246 within sleeve 228. The seal 318 is a pressure activated annular seal that provides sealing forces proportional to the pressure acting on the seal. As the sealing forces increase, the contact unit loads increase correspondingly at all segment seals innerfaces. Conversely, as the pressure acting within the segment seal decreases, the sealing forces and resulting unit loads decrease. Seal 318 is free to move to accommodate relatively run out between valve body 246 and the ported sleeve 228 such that segment seal 299 maintains constant surface contact with inside surface 229 of sleeve 228. Segment seal 299 ensures that the annular clearance 248 between valve body 246 and sleeve 228 is not filled with a fuel/air mixture. This substantially reduces the unburned fuel/air mixture in the combustion chamber 264. When the valve in combustion chamber 264 is aligned with the intake port 231 intake air is supplied to the valving chamber 264 and piston expansion chamber 231 as piston 213 is moving down in a downward direction. As the valve body 246 continues to rotate piston 13 moves in an upward compression stroke the fuel injector 243 introduces a selected amount of fuel into the valving combustion chamber 264 via opening 218 in head plate 217.

Piston 213 as it moves upwardly toward recess surface 230 in head plate 217 compresses the air/fuel mixture in valving combustion chamber 264. The ignition system is then operated to generate a spark in valving combustion chamber 264. The air/fuel mixture in chamber 264 commences to burn with a flame front emanating from spark plug electrodes 262 and 263. The rotating valve body 246 with the combustion chamber 264 provides for stratification of the air/fuel mixture due to the centrifical effects of the richer portion of the mixture which is burned by the flame as it moves through the combustion chamber 264. Seal 252 prevents the air/fuel mixture from entering the annular chamber 248 surrounding valve body 246. This seal 252 is a pressure activated seal which floats with respect to valve body 246. The geometry of valving combustion chamber 264 allows for the intake and exhaust gases to flow to and from the working or piston chamber 230 with minimal restrictions.

Engine 200 can be operated as a Diesel engine. The ignition system is used to assist the cold start of the engine. The fuel injector operates to introduce fuel into valving combustion chamber 264 at the completion of each compression stroke of piston 213. Spark plug 259 can be used to generate electric sparks to assist starting of the Diesel engine. The compressed air and hot temperatures within the combustion chamber causes the air fuel mixture to burn without spark after the engine has been started.

The valve body 246 along with spark plug 259 can be removed as a unit from head 221. Screws 239 attaching cap 238 to head 221 are removed. Valve body 246 along with spark plug 259, ring 236 and cap 238 are removed as a unit from head 221. The intake and exhaust manifolds, fuel injectors, and ignition system of the engine as well as parts of the cooling system are not disturbed during the removal and servicing of the valve assembly.

Refering to FIGS. 15 to 19, there is shown a second modification of the internal combustion engine indicated generally at 400 and valve assembly indicated generally at 427 incorporated into engine 400. Valve assembly 427 and the parts of the engine 400 are the same as the parts of engine 200 and have the same reference numbers with the prefix 4. Engine 400 is a 4-cycle internal combustion engine which is operable as a Diesel engine or alternatively as a gasoline engine.

Figure 15:
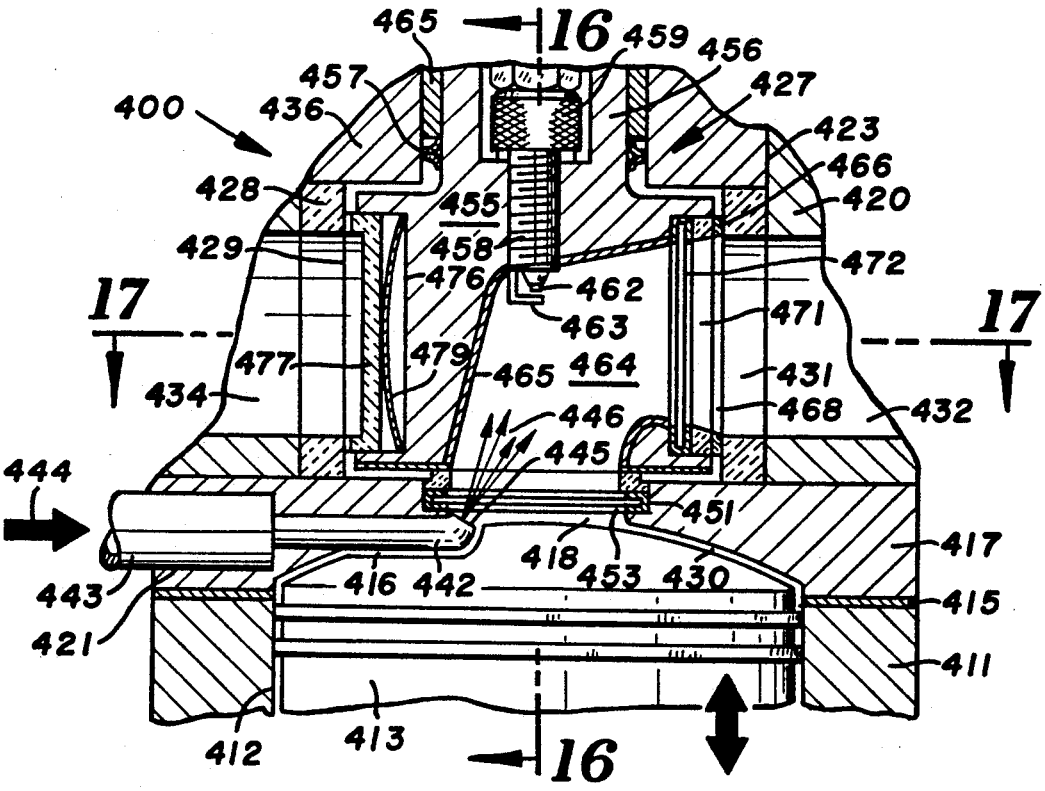
FIG. 15 is a sectional view similar to FIG. 12 of a modification of the engine and rotary valve thereof.
Figure 16:
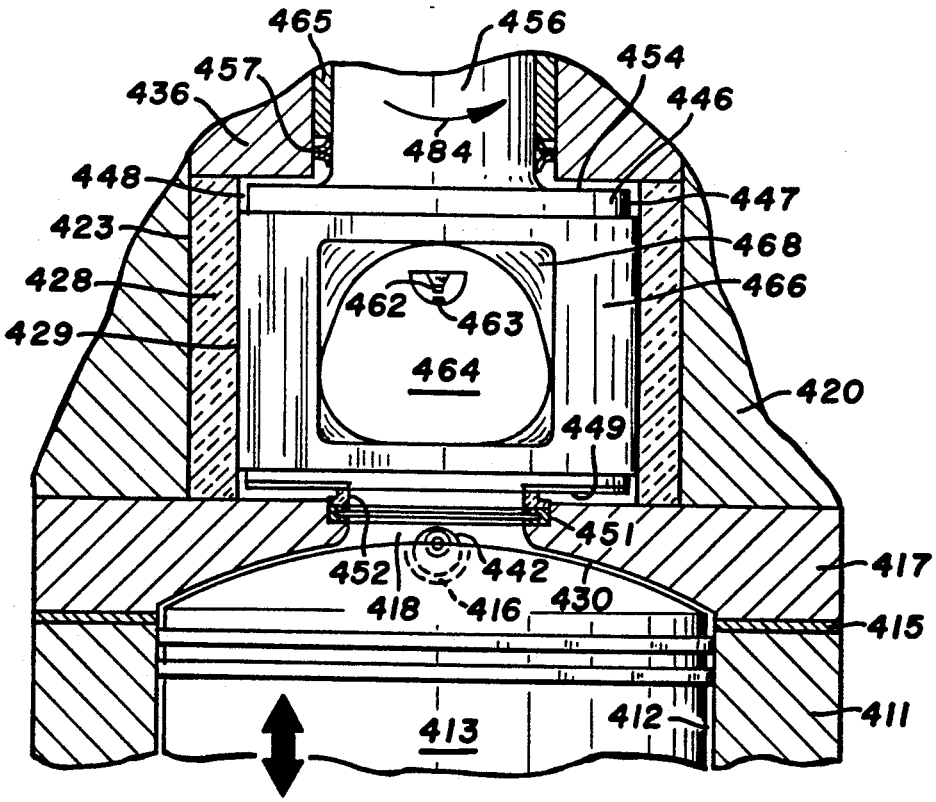
FIG. 16 is an enlarged sectional view taken along line 16—16 of FIG. 15.

As shown in FIGS. 15 and 16, engine 400 has a block 411 with upright bores 412 accomodating a reciprocating piston 413. The number of bores in block 412 can vary according to the design of the engine. Piston 413 is connected to conventionl crank shaft with a connecting rod (not shown). A head plate 417 is positioned on top of block 421 to close the top of the bore 412. A gasket 415 is interposed between head plate 417 and the top of block 411 to seal head plate 417 on block 411. Head plate 417 has a circular opening 418 aligned with the central vertical axis of bore 412 providing passage into the expansion chamber of bore 412.

As shown in FIG. 15, head plate 417 has a side hole 421 accomodating a cylindrical part of a fuel injector 443. Injector 443 has a nozzle 442 terminating in a discharge port 445 for directing atomized fuel as shown by arrows 446 into the rotary combustion chamber 464 of the rotary valve 427. Liquid fuel indicated by arrow 444, such as Diesel oil, compressed and sequentially injected into the combustion chamber by the fuel injector 443. Fuel injector 443 is a conventional injector and does not form part of the invention.

The top of piston has a radial groove 416 for accomodating the discharged end of 445 of injector 443. The discharge end 445 faces upwardly so that the fuel indicated by arrow 446 is discharged through hole 418 and head plate 417 directly into the combustion chamber 464 of rotary valve assembly 427.

Head plate 417 reduces thrust and lateral forces on valve assembly 427 and reduces the quenched volume of the air/fuel mixture adjacent the valving combustion chamber 464. Substantially all of the air/fuel mixture in the valving combustion chamber 464 is exposed to flame fronts with the result of reduction of HC emissions and improved fuel economy.

A head 420 is mounted on top of head plate 417 and attached thereto with a plurality of head bolts (not shown). Head 420 has a vertical bore 423 that accomodates rotary valve assembly 427 for directing the flow of air and/or air and fuel mixture into rotary valving combustion chamber 464. Injector 443 introduces the fuel into the combustion chamber 464 wherein the fuel and air mixture burn. The burning and expanding gases from chamber 464 flow and expand into the expansion chamber of the bore 412 accomodating the reciprocating piston of 413 thereby powering the engine 400.

Figure 17:
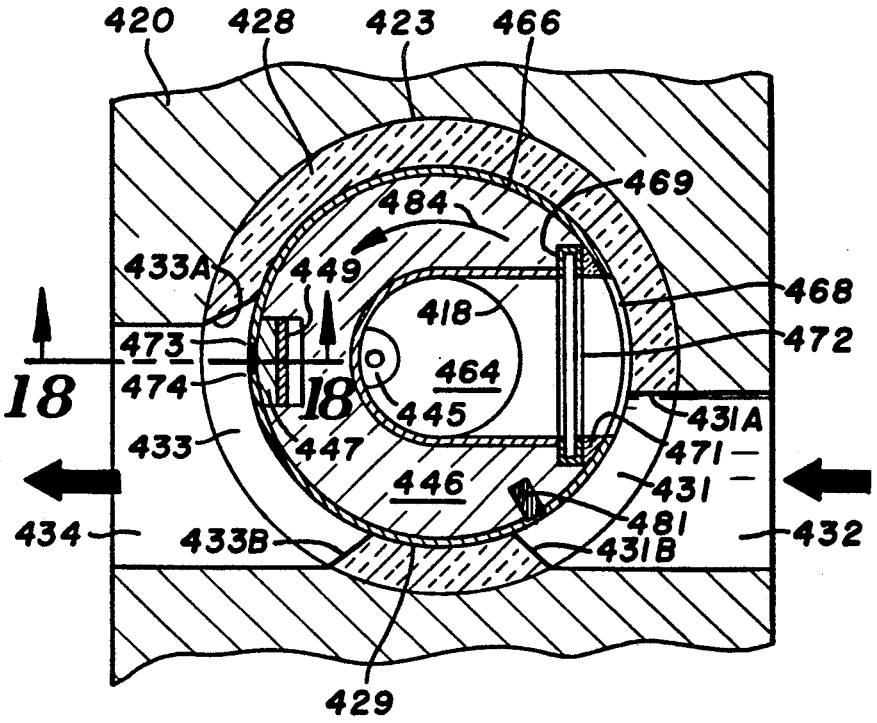
FIG. 17 is a sectional view taken along line 17—17 of FIG. 15.
Figure 18:
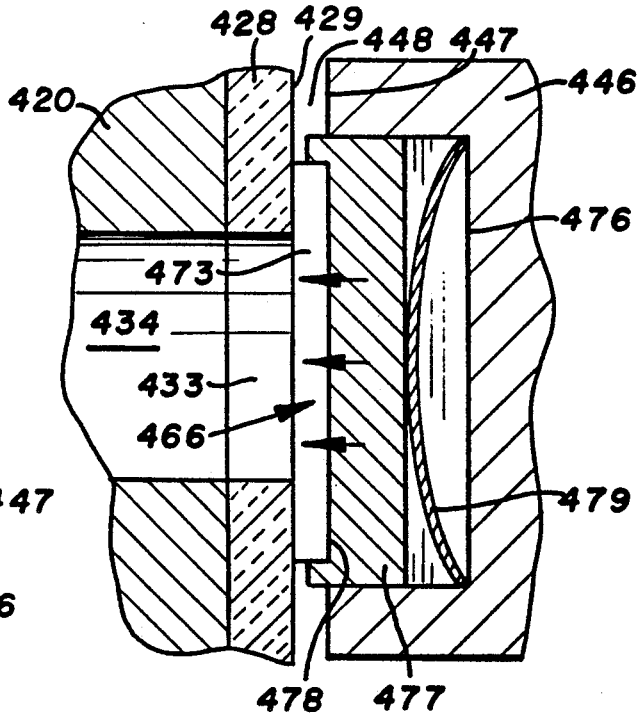
FIG. 18 is an enlarged sectional view taken along the line 18—18 of FIG. 17.

As seen in FIG. 16, 17, and 18 rotary valve assembly 427 has a cylindrical sleeve 428 located in the bottom of bore 423. The lower end of sleeve 428 bears against the top of head plate 417. An annular member or ring 436 retains sleeve 428 in head 420. Sleeve 428 has an inside cylindrical surface 429, an intake port 431, and an exhaust port 433. Intake port 431 is aligned with intake passage 432 located in head 420. Exhaust port 433 is ligned with exhaust passage 434 in head 420 opposite passage 432. Sleeve 428 can be remo ed from bore 423 to fascilitate servicing and repair of the engine. The location of the circumferentially spaced edges 431A, 431B, and 433A and 433B of sleeve 428 forming the intake port 431 and exhaust port 433 can be changed to adjust the timing of the valving events. Replacement of sleeve 428 with alternative sleeve with an appropriate edge locations, such as vertical edges forming square intake and exhaust ports allow the engine to be designed for different efficient operating speeds. Sleeve 428 can be ceramic material, such as silicon nitride, silcon carbide, or a ceramice material including silicon, aluminum, oxygen, nitrogen, and other structural materials. Sleeve 428 of ceramic material functions as a heat insulator which restricts the disapation of heat to head 420. Sleeve 428 an also be made of other materals, such as metal, carbon, or the like. The structure shown in FIG. 12 is used to fix the location of sleeve 428 on head 420.

Rotary valving assembly has a cylindrical valve body 446 located within sleeve 428. Valve body 446 has an outside cylindrical wall 447 located in spaced relation relative to inside wall 446 of sleeve 428 thereby providing an annular cylindrical space 448 between body 446 and sleeve 428. In other words, cylindrical wall 447 of body 446 does not have a precise machine finish as it does not engage wall 429 of sleeve 428 so there is no frictional relationship between walls 446 and 429. A collar seal 466 is located in space 448 to providea sealing relationship between the rotary parts of the rotary valve assembly 427 and sleeve 428.

The bottom of valve body 446 has a flat surface 429 facing head plate 417. The bottom of body 446 can have a ceramic layer or coating to enhance its wear charateristics. Alternatively, the entire body 446 can be made from ceramic material, metal or other structural materials.

Refering to FIGS. 15 and 16, head plate has an annular groove 451 surrounding opening 418. Groove 451 is also open to the bottom 449 of valve body 446. A ring seal 452 located in groove 451 is bias with a circular spring into engagement with the bottom surface 449 of valve body 446. Seal 452 is a pressure active face seal that has a high unit load on bottom surface 449 during the compression and power strokes of piston 413. A high unit load is effective by transfer of high pressure gases into the annular space surrounded by circular spring 453. Seal 452 is preferably made of ceramic material to enhance its wear and temperature characteristics. Alternatively, a split ring located in annular groove 451 may be used to engage seal 452 with a spring in the groove to holde seal 452 in sliding sealing engagement with the bottom surface 449 of valve body 446.

Valve body 446 has generally flat top annular wall 454 facing the bottom of ring 436. An upright tubular shaft or stem 456 is joined to the center portion of top wall 454 and extends upwardly through ring 436 and is connected to the drive structure for the rotary valve assembly. The worm and gear drive structure for rotating the valve body 446 is shown in FIG. 12. A sleeve bearing 465 rotatably supports stem 456. A lip seal 457 is located between ring 436 and stem 456 adjacent valve body 446.

As seen in FIG. 15, the center of valve body 446 has an upright threaded bore 458 accomodating the threaded end of an ignitor 459. Ignitor 459 is a device to generate an electric spark to ignite the air/fuel mixture in the rotary combustion chamber 464. Ignitor 459 can be a spark plug or glow plug which is operable to periodically generate a spark to assist the staring of the Diesel engine or an intermitant spark to operate a 4-cycle gasoline engine. The lower end of ignitor 459 has spaced electrodes 462 and 463 located in the upper center portion of combustion chamber 464.

The internal wall surfaces of valve body 446 that forms combustion chamber 464 is covered with a layer of ceramic material 465 to reduce heat transfer to the metal of valve body 446. Alternatively, the valve body 446 can have an uncoated internal wall forming combustion chamber 464.

Refering the FIGS. 16 and 17, collar or band seal 466 has an outside cylindrical surface 467 located in contiguous relationship relative to the inside surface 429 of sleeve 428. Seal 466 is a cylindrical split band seal having a square hole 468 aligned with combustion chamber 464. Hole 468 has an upright or vertical dimension that is substantially the same as the vertical dimension as the intake port 431 and exhaust port 433. Valve body 446 has a groove 469 surrounding the inlet end of combustion chamber 464. A ring seal 471 and pressure response of spring 472 are positioned in groove 469 and bias the seal 466 surrounding the square hole 468 into surface engagement with sleeve 428. Spring 472 is a pressure responsive structure that increases the sealing forces on seal 466 during compression and power episodes of the engine. Seal 466 has vertical spaced apart ends 473 and 474 opposite hole 468. Ends 473 and 474 are located adjacent a vertical pocket 476 in valve body 446 a holding member 477 is slideably located in pocket 476. The outer portion of member 477 has a recess 478 accomodating the ends 473 and 474 of seal 466. A bow spring 479 located in recess 478 biases holding member 477 and the ends 473 and 474 of collar seal 446 in an outward direction into light frictional engagement with the inside surface 429 of sleeve 428. Member 477 maintains the vertical positions the ends 473 and 474 of collar seal 466 relative to valve body 446.

Figure 19:
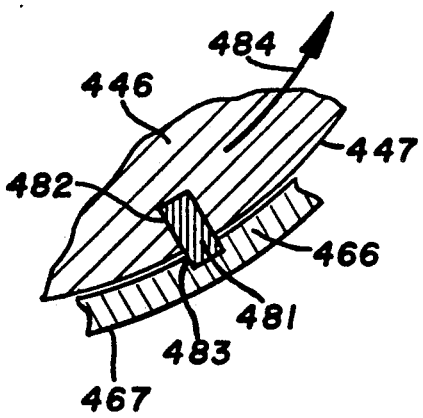
FIG. 19 is an enlarged sectional view of part of FIG. 17 showing the driving pin for the collar seal of the rotary valve.

Seal 466 is retained in circumferential fixed relation relative to valve body 446 with a drive pin 481, as seen in FIGS. 17 and 19. Pin 481 has an inner end located in a hole 482 in valve body 446. The outer end of pin 481 is positioned in a pocket 483 in the inside portion of seal 466 thereby preventing seal 466 from rotating or moving circumferentially relative valve body 446 but allowing limited radial movement of seal 466 relative to body 446. Additional pins can be used to circumferentially retain seal 466 on valve body 446.

In use rotary valve assembly 427 is indicated by rotated by arrow 484 in timed relation with the reciprocation of piston 413 to sequentially allow air to flow into valve combustion chamber 464 and the chamber of bore 412. Collar seal 466 of valve assembly 427 as it turns, then seals the inlet of the combustion chamber 464 whereby upward movement of piston 431 compresses the air in chamber 464. Fuel injector 443 then introduces a Diesel hydrocarbon fuel into chamber 464 which ignited due to the compression of the air in chamber 464. The flame front moves through chamber 464 expanding the gas therein. The expanding gas forces piston 431 downwardly in the power stroke of the engine. Collar seal 466 has a large surface engagable with the inner wall of sleeve 428 which effectively seals the gas in chamber 464 with a minimum of wear and friction on the seal and sleeve.

While there has been shown and described preferred embodiments of the internal combustion engine, rotary valve assembly and seals thereof, it is understood that changes in the structure, materials, a..d arrangement of structure can be made by those skilled in the art without departing from the invention. The invention is defined in the following claims.

We claim:

1. An internal combustion engine comprising: a block having at least one cylindrical wall surrounding a cylinder, piston means located in said cylinder, means operable to reciprocate the piston means in said cylinder, head means mounted on the block covering said cylinder, said head means having an intake passage for intake gas, an exhaust gas passage for exhaust gas, and a cavity with an inner surface open to the cylinder, and open to said passages, a rotary valve assembly having a valve body located within said cavity, the valve body having a valving combustion chamber and an outer surface spaced from the inner surface of the cavity to enable the valve body to rotate and thereby control the flow of intake gas from said intake passage into said valving combustion chamber of the rotary valve assembly and the cylinder and the flow of exhaust gas out of the valving combustion chamber of the rotary valve assembly and the cylinder to said exhaust gas passage, such flow occuring via said valving comustion chamber in the valve body open to the cylinder and said inner surface of the cavity, first seal means mounted on the valve body having a hole in alignment with an outer portion of the valving combustion chamber and the inlet and outlet passages, said first seal means having a surface surrounding the hole located in sliding sealing engagement with an arcuate section of the inner surface of the cavity, means connecting the first seal means to the valve body whereby the first seal means rotates with the valve body, second seal means between the first seal means and the body allowing limited movement of the first seal means relative to the body to maintain the sealing relationship between the surface of the first seal means that engages the inner surface of the cavity and block the flow of the intake gas, and exhaust gas into the space between the outer surface of the valve body, third seal means cooperating with said valve body and head means to block the flow of the intake gas, and exhaust gas into the space between the valve body and inner surface of the cavity, means for introducing combustible fuel into the combustion chamber, and means operable to rotate the rotatable valve body and first seal means in timed relation with the movement of the piston means whereby said engine has intake, compression, power, and exhaust strokes.

2. The engine of claim 1 including: biasing means located between the valve body and first seal means to bias the latter into engagement with the cavity inner surface.

3. The engine of claim 2 wherein: the second seal means is a circular gas pressure responsive seal surrounding the valving combustion chamber and engageable with the valve body and the first seal means to bias the latter into engagement with the cavity inner surface.

4. The engine of claim 3 wherein: the circular seal includes an annular face seal for engagement with the valve body and means for biasing the face seal into said engagement.

5. The engine of claim 3 including: a ring shield located inwardly of the circular seal between the valve body and the seal means.

6. The engine of claim 1 wherein: the head means includes a head plate having an opening in communication with the cylinder and valving combustion chamber, and said third seal means is an annular seal means between the head plate and the valve body, said annular means surrounding said opening.

7. The engine of claim 6 wherein: said annular seal means inludes an annular face seal for sealing engagement with the valve body and gas pressure responsive means for biasing the face seal into said engagement.

8. The engine of claim 1 including igniter means operable to initiate combustion of the air/fu 1 mixture in the combustion chamber.

9. The engine of claim 8 wherein: the igniter means comprises a spark generating means mounted on the valve body.

10. The engine of claim 1 wherein: the first seal means comprises an annular collar surrounding the valve body, said collar having an opening for allowing intake gas and exhaust gas to flow into and out of the combustion chamber, arcuate surfaces adjacent opposite sides of the opening located in surface engagement with the inner surfase of the cavity, and ends spaced from each other generally opposite said opening.

11. The engine of claim 10 including: holding means mounted on the body for supporting the ends of the collar on the body.

12. The engine of claim 11 wherein: the body has a pocket, said holding means comprises a member located within the pocket, said member having a recess accommodating the ends of the collar, and biasing means located within the pocket and engageable with the member to bias the ends of the collar toward the inner surface of the cavity.

13. The engine of claim 1 including: a sleeve located within the head means, said sleeve having said inner surface surrounding the cavity accommodating the valve body.

14. The engine of claim 13 wherein: the first seal means comprises an annular collar surrounding the valve body, said collar having an opening for allowing intake gas and exhaust gas to flow into and out of the combustion chamber, arcuate surfaces adjacent opposite sides of the opening located in surface engagement with the inner surface of the cavity, and ends spaced from each other generally opposite said opening.

15. The engine of claim 14 including: holding means mounted on the body for supporting the ends of the collar on the body.

16. The engine of claim 15 wherein: the body has a pocket, said holding means comprises a member located within the pocket, said member having a recess accommodating the ends of the collar, and biasing means located with in the pocket and engageable with the member to bias the ends of the collar toward the inner surface of the cavity.

17. The engine of claim 1 wherein: the means for introducing fuel into the valving combustion chamber includes a fuel injector mounted on the head means operable to dispense fuel into the air in the valving combustion chamber.

18. The engine of claim 1 including: a head plate located between said block and head means, said head plate having an opening to said cylinder aligned with the valving combustion chamber in the valve body, said third seal means located between the head plate and valve body and surrounding the opening in the head plate.

19. The engine of claim 18 wherein: the means for introducing fuel into the valving combustion chamber including fuel dispensing means mounted on the head plate operable to dispense fuel into the gas in the valving combustion chamber.

20. The engine of claim 18 wherein: said head plate has hole means open to one side therof and open of said cylinder, fuel injector means having a portion thereof located in said hole means operable to dispense fuel into the gas in the valving combustion chamber.

21. An internal combustion engine comprising: a block having cylindrical wall means surrounding at least one piston chamber, piston means located in said piston chamber, means operable to reciprocate the piston means in said chamber, a head plate located on the block over the piston chamber, said head plate having an opening in communication with said chamber, head means mounted on the head plate covering said opening, means securing the head means and head plate to the block, said head means having an air intake passage and an exhaust gas passage, rotary valve means operatively associated with the head means for controlling the flow of air into said piston chamber and the flow of exhaust gas from said piston chamber, said head means having an inner surface surrounding a bore open to said piston chamber, said valve means having a body located in said bore, said body having a valving combustion chamber continuously open to said opening and sequentially open to said air intake passage and exhaust gas passage, first seal means mounted of the valve body, said first seal means having a passage providing an outer portion of the valving combustion chamber, said outer portion of the valving chamber being sequentially aligned with said air intake passage and the exhaust gas pasage during rotation of the valve body, second seal means mounted on the head plate engageable with the valve body surrounding the opening in the head plate, means mounted on said head plate operable to introduce fuel into the valving combustion chamber, and means operable to rotate said valve body in timed relation with the movement of the piston means whereby said engine has an intake, compression, power, and exhaust strokes.

22. The engine of claim 21 wherein: said housing includes a sleeve having said inner surface, said sleeve having an air intake port and an exhaust gas port open to the air intake passage and exhaust gas passage and the outer portion of the valving chamber respectively.

23. The engine of claim 21 wherein said head plate has hole means open to one side thereof and said opening to said piston chamber, said means mounted on the head plate includes fuel injector means having a portion thereof located in said hole means operable to dispense fuel into the air in the valving combustion chamber.

24. The engine of claim 21 wherein: the means mounted on the head plate includes fuel dispensing means mounted on the head plate operable to dispense fuel into the air in the valving combustion chamber.

25. The engine of claim 21 including: first means mounted on the valve body responsive to gas pressure within the combustion chamber to increase and decrease the forces on the first seal means proportional to the gas pressure within the combustion chamber, and second means mounted on the head plate responsive to gas pressure within the combustion chamber to increase and decrease the forces on the second seal means proportional to the gas pressure within the combustion chamber.

26. The engine of claim 21 including: igniter means operable to initiate combustion of the air/fuel mixture in the combustion chamber.

27. The engine of claim 26 wherein: the igniter means comprises a spark generating means mounted on the valve body.

28. The engine of claim 21 wherein: the first seal means comprises an annular collar surrounding the valve body, said collar having an opening for allowing intake gas and exhaust gas to flow into and out of the combustion chamber, arcuate surfaces adjacent opposite sides of the opening located in surface engagement with the inner surface of the cavity, and ends spaced from each other generally opposite said opening.

29. The engine of claim 28 including: holding means mounted on the body for supporting the ends of the collar on the body.

30. The engine of claim 29 wherein: the body has a pocket, said holding means comprises a member located within the pocket, said member having a recess accommodating the ends of the collar, and biasing means located within the pocket and engageable with the member to bias the ends of the collar toward the inner surface of the cavity.

31. A rotary valve assembly having housing means having an inner surface surrounding a cavity and fluid inlet and outlet ports open to the inner surface comprising: rotatable valving means located within the cavity of the housing means for controlling the flow of fluid into and out of the valve assembly, said rotatable valving means having a valving chamber with a first end open to means for supplying fluid and a second end open to means to accommodate a fluid, said rotatable valving means having a valve body, said valve body having an outer surface spaced from the inner surface of the housing means, first seal means mounted on the valve body engageable with said inner surface of said housing means, said first seal means having a passage in communication with the valving chamber and open to said inner surface to allow fluid to flow into and out of said chamber, means connecting the first seal means to the valve body whereby the first seal means rotates with the valve body, second seal means located between the first seal means and the valve body allowing limited movement of the first seal means relative to the valve body to maintain sealing relationship between the inner surface of the housing means and first seal means to block the flow of intake gas and exhaust gas into the space between the valve body and inner surface of the housing means, and third seal means cooperating with the valve body to block the flow of intake gas and exhaust gas into the space between the valve body and inner surface of the cavity.

32. The valve assembly of claim 31 wherein: the first seal means comprises an annular collar surrounding the valve body, said collar having an opening for allowing fluid to flow into and out of the valving chamber, arcuate surfaces adjacent opposite sides of the opening located in surface engagement with the inner surface of the housing means and ends spaced from each other generally opposite said opening.

33. The valve assembly of claim 32 including: holding means mounted on the body for supporting the ends of the collar on the body.

34. The valve assembly of claim 33 wherein: the body has a pocket, said holding means comprises a member located within the pocket, said member having a recess accommodating the ends of the collar, and biasing means located within the pocket and engagable with the member to bias the ends of the collar toward the inner surface of the housing means.

* * * * *